United States Patent [19]

Windsor, Jr.

[11] Patent Number: 4,875,874

[45] Date of Patent: Oct. 24, 1989

[54] ELECTRICAL CONNECTOR SECURING ARRANGEMENT

[76] Inventor: John F. Windsor, Jr., 4501 Raymar Dr., Orlando, Fla. 32809

[21] Appl. No.: 266,826

[22] Filed: Nov. 3, 1988

[51] Int. Cl.[4] ..... H01R 13/62

[52] U.S. Cl. ..... 439/364; 439/372

[58] Field of Search ..... 439/366, 367, 368, 369, 439/370, 371, 372, 345, 350, 357, 358; 285/320

[56] References Cited

U.S. PATENT DOCUMENTS

| | | | |
|---|---|---|---|
| 2,389,895 | 11/1945 | Colley et al. | 439/372 X |
| 2,487,801 | 11/1949 | Healy, Jr. | 439/369 |
| 2,753,536 | 7/1956 | Tjader | 439/369 |
| 3,484,736 | 12/1969 | Wyse | 439/255 |
| 4,097,105 | 6/1978 | Zumwalt | 439/369 |
| 4,204,738 | 5/1980 | Tillotson | 439/369 |
| 4,596,430 | 6/1986 | Olson | 439/369 |
| 4,603,933 | 8/1986 | Hoer | 439/369 |

*Primary Examiner*—Neil Abrams
*Assistant Examiner*—Khiem Nguyen
*Attorney, Agent, or Firm*—Julian C. Renfro

[57] ABSTRACT

An electrical connector securing arrangement is provided in accordance with this invention for use upon the female socket of an extension cord, to prevent the unintentional separation from the socket of a male plug that has been interfitted therewith. The connector securing arrangement comprises a socket having thereon a pivotally mounted latch member rotatable between extreme positions that are more than 180 degrees apart, and a compatible male plug utilized with the socket. The rotatable latch member has a central locking portion able to releasably engage a portion of the plug when the rotatable latch member is in one position of its rotation, and thus effectively help prevent undesired separation of the socket and plug when interfitted. The central locking portion of the rotatable latch member is able to be stowed unobtrusively on a certain designated part of the body of the socket when the socket and the plug have been spearated, and the rotatable latch member has been moved to an extreme position of its rotation. The stowing of the rotatable latch member in the unobtrusive location on the socket serves very effectively to prevent same from becoming snagged on a nearby object during use.

10 Claims, 3 Drawing Sheets

ELECTRICAL CONNECTOR SECURING ARRANGEMENT

BACKGROUND OF THE INVENTION

This invention relates to a rotatable electrical connector arrangement for the secure, snag free interlocking of the socket or female end member of an electrical power extension cord, to the plug or male end member of an electrical power implement, or to any related device having a male plug member affixed to its power cord.

Power extension cords are often necessary in order to be able to transmit electricity from a conventional electrical power outlet to a distant implement, thereby providing the implement with a source of electricity even when it is used at locations remote from the outlet.

A common problem experienced by construction workers, for example, and particularly those using electrical power tools served by long extension cords, is the inadvertent uncoupling of socket and plug members. Such uncoupling most usually results from tensioning of the cord while a cord segment is temporarily held by an obstruction of one sort or another. The workman, in an attempt to release the cord, pulls upon the cord, resulting in the uncoupling of the socket and plug, whereupon work time is subsequently lost in recoupling same. Where a workman, such as a carpenter, is using a power tool in a multi-floor structure, such uncoupling can be particularly troublesome and time consuming.

Because of the nature of such implements and the necessity of remote use, it is essential that they be able to be moved from one location to another, or in other words, possess a degree of mobility. The necessity for this mobility aspect of the implement frequently presents problems relating to the maintenance of continuous and secure connection of the implement to the power transmission cord.

Prior designs have attempted to solve this problem in a number of ways. All proffered solutions to date, however, have had a number of inherent disadvantages.

In recent years, many arrangements have been proposed for preventing accidental separation of a coupled socket and plug, and a drawback to most such arrangements is their complexity, resulting in a high cost of manufacture, as well as awkward installation of the plug and socket. An additional drawback to known socket and plug harnesses is their restricted adaptability to only a very limited range of socket and plug combinations.

Other prior art arrangements have involved socket and plug members that are intended to be twisted together in order to effectively resist separation, with the members not being separable until they are twisted back in the opposite direction. Unfortunately, however, another person coming upon this type of device will usually not realize that twisting of one member with respect to the other is necessary for separation of the members, and he will therefore encounter quite a frustration.

The Healy Pat. No. 2,487,801 entitled "Connector Clamp"exemplifies a complex way of going about enabling male and female electrical components to be locked together. It will be noted that Healy utilizes a very involved construction, entailing numerous separate parts and too many pivot points. It is most important to observe that the toggle link ends of Healy protrude beyond the female end of the device when male and female parts have been separated, with the inventor having made no provision for stowing the toggle link ends in out-of-the-way locations.

It is significant to note that the Healy "plug" is not usable with an unlike mating part, for his very restrictive design requires a specific socket arrangement.

It is therefore to be seen that it is most desirable to employ socket and plugs utilizing relatively inexpensive components, having clean lines and arranged such as to avoid snagging on protruding objects, with the male and female components each being able to be utilized with standard connectors.

The Tillotson Patent No. 4,204,738 entitled "Electrical Connector Retaining Device" utilizes a wire "bail" on the male member which, most unfortunately, cannot be stowed in an out-of-the-way position when not in use. This is not the only unfortunate characteristic of the Tillotson device, for the hood used around the male connector prevents the user from installing the male connector in a conventional wall outlet. In other words, the Tillotson device's hood severely limits the applicability of this arrangement, meaning that it probably can only be used on the handle of some relatively large electrical device, such as a weed wacker. If used on a hand tool such as an electric saw, drill, sander or polisher, this teaching would result in an unwieldy and bulky device that would be rejected by most users.

It was to overcome these and other such disadvantages of the prior art that the instant invention was evolved.

SUMMARY OF THE INVENTION

An arrangement is herein provided for the secure coupling and interlocking of electric socket and plug combinations when utilized as integral parts of an electrical extension cord/electrical appliance "hold fast" connection. My novel area engagement comprises a plurality of principal component elements, the first being a female socket member permanently affixed, by a state of the art manufacturing process, to a suitable extension cord, preferably a 110 volt three wire extension cord, with ground wire. This invention preferably envisions the use of a uniquely configured standard (U.S.) 110 volt, three prong plug used with my female socket member, but obviously I am not to be limited to this, for the broad principles of my invention are such as to enable my novel concepts to be incorporated into any of a number of other plug and socket configurations, such as are to be found in foreign countries, for example.

A second principal component of my invention involves a rotatable latch member pivotally attached to the aforementioned female socket member, with such rotatable latch member being movable between extreme positions that are somewhat more than 180 rotational degrees apart, such positions being from a recessed stow position, to a fully open position.

My novel rotational latch member advantageously has means thereon for removable attachment to a compatibly configured male plug member, and more particularly, the rotatable latch member includes a central latching portion able to releasably engage a raised portion of a compatibly configured male plug member when the rotatable latch is in a particular extended position of rotation. The total amount of rotation involved is something more than 180 degrees, and in some instances may approach 270 degrees of rotational movement out of the stowed position, to the position in which the plug can be received. Thereafter, the rotatable latch member is utilized to prevent undesired separation of a male plug member affixed to a power drill for example.

Advantageously, my novel rotatable latch is stowable on a certain part of the structural body of the female socket member, hereinafter designated as the top surface of the female socket, after the rotational latch member has been moved so as to unlatch the compatible female and male component members, and these members unplugged and separated. At that time, the rotatable latch member can be moved to a closely adjacent position in line with the top surface of the female socket member, where it can be stowed unobtrusively. The stowing of the rotatable latch member in a recessed, out-of-the-way position serves to prevent same from becoming a hindrance or becoming snagged on nearby objects when the extension cord to which it is affixed is used with any ordinary two wire or three wire male electric plug. It is thus to be seen that my socket with its rotatable latch member is usable as an important component of my novel rotatable latch system, or with the latch in the out-of-the-way, stowed position, the socket is then fully effective as a common ordinary extension cord, usable in a snag-proof manner with any two or three wire standard male electric plug.

To assist the tight interlocking of the female socket and the male plug members, I prefer to utilize the rotatable latch member having a pair of legs of equal length, with inwardly curved elevated surfaces located on the interior or inboard side of each leg, closely adjacent its pivot locations. Each inwardly curved surface corresponds exactly to an arc scribed from the exact center of each applicable pivot point. Each inwardly curved elevated surface is arranged so as to physically engage a respective outwardly curved elevated surface located on the side of the compatibly configured male plug when the female and male members have been connected. The interfitting of the female and male members causes the socket member and the male plug members to tightly engage when the rotatable latch is rotated to the latching position, in which the curved latching portions are closely adjacent, with the undesired separation of socket and plug thus being effectively prevented.

The third principal component of the instant rotatable latch arrangement is a suitably configured male plug member duplicates of which may for example, be permanently affixed in the manufacturing process to a multitude of relatively short (six feet or less) electrical cords which are meant to be attached to all portable electrical hand tools and appliances for the purpose of insuring them of a reliable "hold fast", snag free electrical connection. Each male plug member may be fitted as three wire/three prong connector, or as in the case of more recent "double insulated" hand tool and appliances, as a two wire/two prong connector. Either three or two prong plugs will work equally well with my socket, provided the external physical interlocking configuration is designed and constructed so as to be compatible with the instant invention. Obviously I am not to be limited to U.S. plug and socket convention, for my invention is broad enough to be effectively used with a wide variety of other plug and socket configurations. Also, my invention may be effectively utilized with long extension cords as well as short ones.

In addition to the aforementioned manufactured attachment of the interlocking male plugs to a myriad of electrical tool and appliance cords, it is also my intention to equip the remote end of the previously described female socket/extension cord combinations with compatible male plug members in accordance with this invention, thereby allowing for a series of extension cords to be attached in combination in a secure interlocking manner, for the purpose of conveying electrical power to a remote electrical tool or appliance.

It is therefore a principal object of this invention to provide a rotatable electrical socket and plug securing arrangement for home or industrial use that is effective in preventing the undesired separation of interfitted female and male members, the utilization and operation of the securing arrangement being readily apparent to any user.

It is another object of this invention to provide a female member or electrical socket utilizing a pivotally mounted, rotatable latch member having thereon a portion able to releasably engage a portion of the associated male member or plug, to effectively prevent the undesired separation of the female and male members, which rotatable latch member can be readily stowed in a recessed out-of-the-way position on the female member when not in use, or when the cord is being used with a common, non-interlocking male plug.

It is still another object of this invention to provide an inexpensive and highly effective electrical connector securing arrangement whose mode of operation is readily apparent from visual inspection, thus enabling a first time user to be able to either connect or readily release a related pair of interfitting electrical members.

It is yet still another object of my invention to provide an electrical connector securing arrangement that is inexpensive to manufacture, easy to use and maintain, and highly effective to prevent undesired separation of the socket and plug components.

A further object of my invention is to provide a streamlined, snag free interlocking combination that will be equally snag free when used in combination with compatible interlocking components or with non-compatible, non-interlocking ordinary male electric plugs without modification of any sort.

DETAILED DESCRIPTION

Figure 1:
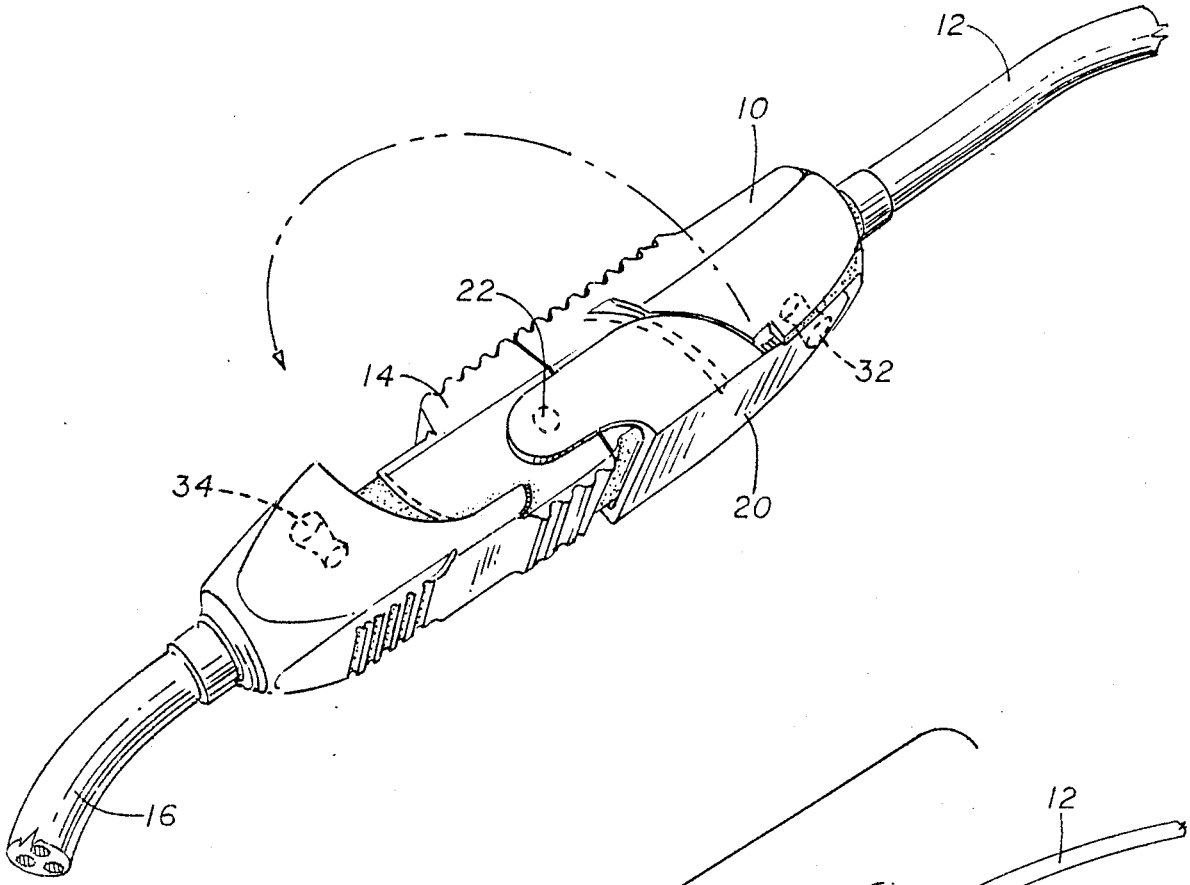
FIG. 1 is a perspective view of my novel electrical rotatable connector securing arrangement for preventing unintentional separation of female and male connectors, with the underside of the joined connectors being turned to reveal the use of a novel rotatable latch member or mechanism in accordance with this invention.

With initial reference to FIG. 1, it will there be seen that I have shown an electrical connector securing arrangement in accordance with this invention, in which the female and male electrical members are in their active or assembled form, and held in this current-passing relationship by means of my novel rotatable latch member. In this figure, the male electrical member or plug 10 is on the right, and mounted at the end of an electric cord 12 leading to an electric appliance such as an electric drill, saw, grinder, sprayer or the like.

On the left in FIG. 1 is the female electrical member or socket 14, which is mounted on the end of an electric cord 16, this latter cord being, for example, an extension cord.

The female and male electrical members are advantageously arranged to be held together in accordance with this invention by means of a rotatable latch member 20, which is mounted on aligned pivot points 22 upon the left and right sides of the female member or socket 14, relatively close to the holes or apertures of the socket that are actually entered by the prongs of the male plug when the two electrical connectors are interfitted. Only one of the pivot points 22 is visible in FIG. 1, but both are to be seen in FIG. 4.

Figure 2:
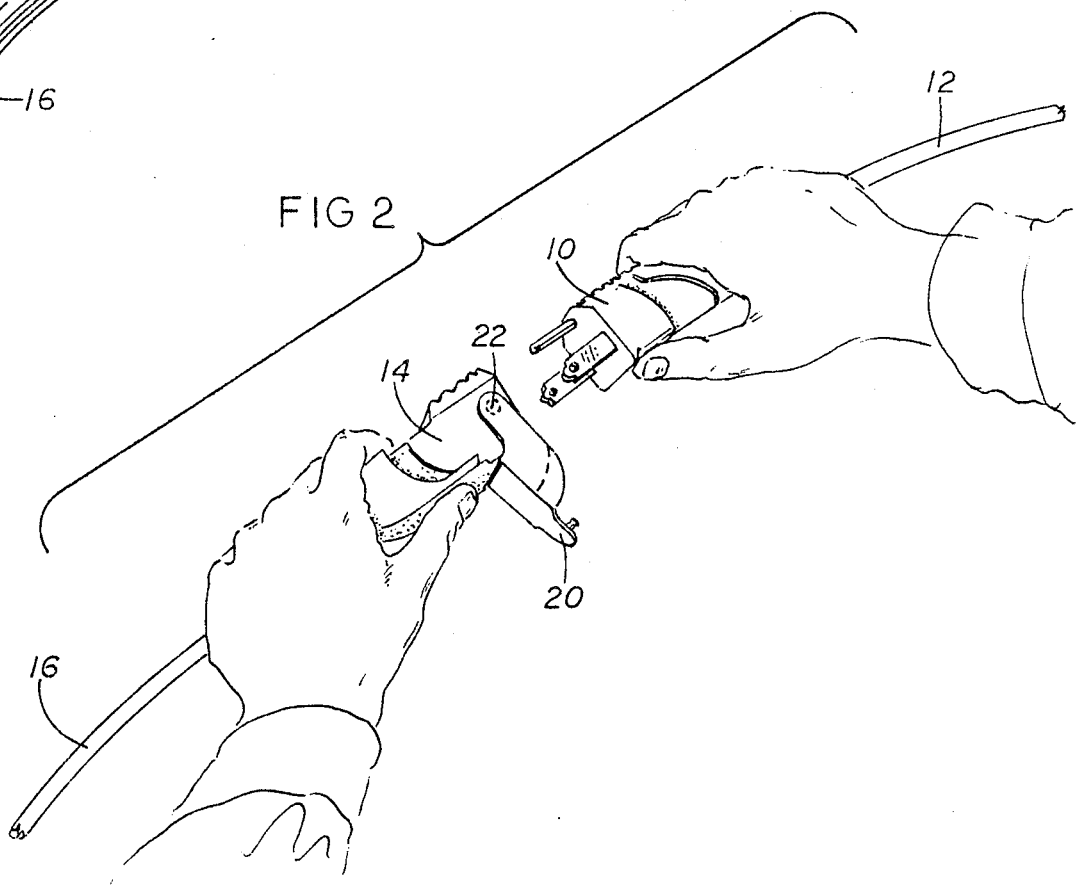
FIG. 2 is a perspective view revealing the male member or plug about to be inserted into the female member or socket, with the rotatable latch member of the socket here shown having been rotated 270° out of its stowed position to permit the joining of the two electrical connectors.

The relationship of electrical components is made more clear by FIG. 2, where the components of the three-prong male plug are clearly visible. In this instance the rotatable latch member 20 is shown hanging down approximately 90° away from the imaginary central axis shared by the male plug 10 and the female socket 14 as they are being brought to ward a connected configuration. It is to be noted, however, that the rotatable latch member 20 does not need to rotate this far in order to permit the male and female members to be connected, as will be discussed hereinafter.

Continuing with FIG. 2, the pivot point 22 of the rotatable latch member 20 is seen to be closely adjacent the front surface of the socket member 14. Unlike the locking or latching means utilized by some electrical plug locking arrangements of the prior art, where the locking or latching member is a considerable hindrance to the free use of the separated plug and socket components, in accordance with this invention, the rotatable latch member 20 has a stowed location on the female member 14 in which it is securely held in an out-of-the-way and unobtrusive position, as will be discussed shortly, in connection with FIG. 6*a*.

Figure 6A:
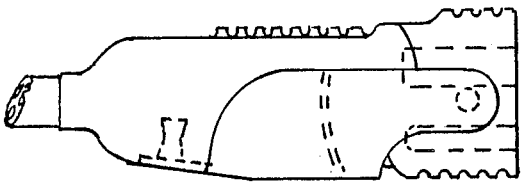
FIG. 6*a* is a side elevational view of the inverted female socket with the rotatable latch member in the stowed or unobtrusive position.

The chances of the female member and its rotatable latch member 20 becoming snagged on an obstruction are minimal in accordance with my advantageous design, because the clean lines presented by the rotatable latch member in the stowed or latched position illustrated in FIG. 6*a* are not such as to permit any snagging from taking place.

Figure 3:
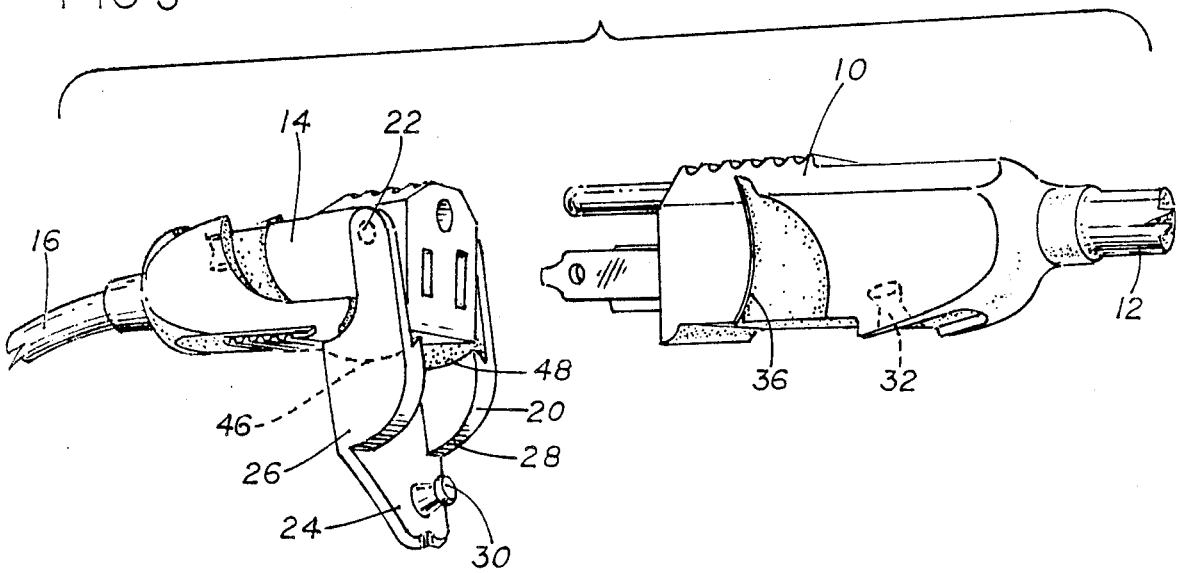
FIG. 3 is a view of the separated female and male electrical members to a larger scale, to illustrate the raised, outwardly curved shoulder on the male member, and the snap lock button used on the rotatable latch member, which button or protuberance is intended to be inserted into a recess or receptacle utilized on the rear body of the male plug when the female and male members are to be connected and then locked together.
Figure 4:
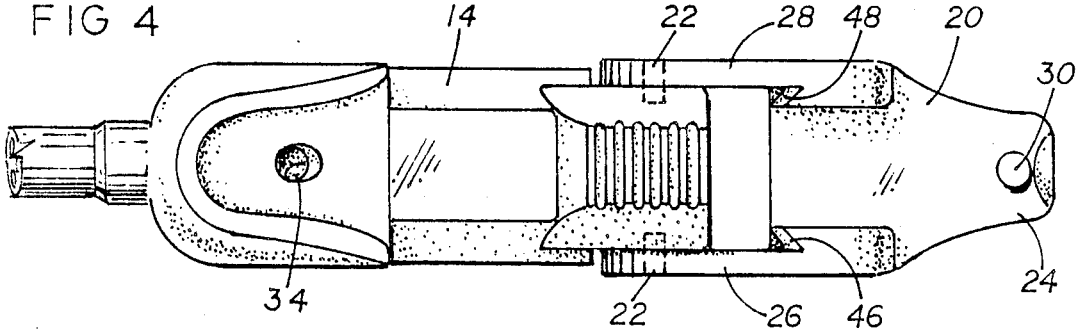
FIG. 4 is a view of the top side of the female socket, with the rotatable latch member having been moved to the outwardly extended position in order to reveal the inwardly curved portions on the interior surfaces of the legs of the rotatable latch member.

In FIG. 3 I reveal the separate socket and plug components in more detail, with the manner in which the rotatable latch member 20 is mounted on the aligned pins or pivot points 22 on the sides of the socket member being made quite clear. The rotatable latch member 20 is depicted in FIGS. 3 and 4 to be of bifurcated construction, having a pair of equal length legs 26 and 28, that support a semi-flexible, spring-like outer end or outer portion 24, upon which is mounted a snap lock button or protuberace 30.

As will be discussed in more detail hereinafter, the snap lock button 30 plays an important role in preventing undesired displacement of the rotatable latch member 20 from either the position shown in FIG. 1 in which the male member is engaged, or from the position shown in FIG. 6*a* in which the rotatable latch member is stowed in an out-of-the-way, snag-free position on the upper side of the socket or female member 14.

Continuing with FIG. 3, it is to be noted that on the interior side of the near leg 26 is an inwardly curved portion or surface 46, this inwardly curved portion being depicted in FIG. 3 by the use of dashed lines. Clearly visible in FIG. 3 on the interior side of leg 28 is curved portion or surface 48, the curved portions or surfaces 46 and 48 being cut at the same radius, and provided for a purpose to be discussed shortly.

Also in FIG. 3 is shown the male plug 10, with this figure revealing an outwardly curved shoulder 36 on the near side of the plug as viewed in this figure. Illustrated by the use of dashed lines in FIG. 3 is the hour-glass shaped receptacle 32 formed in the plug 10, in order that the snap lock button 30 may be received therein when the male and female components are connected and locked together as depicted in FIG. 1.

FIG. 4 reveals the upper surface of the female member or socket 14 with the latch member 20 in the outwardly extended position, with recess or receptacle 34 revealed, which is positioned on the top side of the female member 14 to receive the snap lock button 30 when the rotatable latch member is being moved into its stowed position. I prefer for the receptacle 34 to likewise be of "hour-glass" configuration.

Continuing with FIG. 4, it is to be realized that I prefer for the inwardly curved portions 46 and 48 created on the interior portions of the legs 26 and 28 (of the rotatable latch member 20) to be contoured in a way to increase holding power, with this being accomplished by creating an inwardly facing angle of approximately 45° on each inwardly curved contour, as depicted in FIG. 4. Accordingly, I reveal in FIG. 5 that I prefer to contour the outwardly rounded edges of the shoulder members 36 and 38 to present an angle of approximately 45°, in order to receive the complementary curved portions 46 and 48, respectively, and thus substantially increase the effectiveness of the clamping effort.

Returning now to a consideration of the previously-mentioned snap lock button 30, this component is typically of deformable plastic or the like, and designed to fit into receptacle or recess 32 that is located in the plug member 10. To enhance the capture and retention of the snap lock button, the receptacle 32 is preferably of "hour-glass" shape, and disposed at an angle, as will be noted from FIG. 3. I also prefer for the snap lock button 30 to be of "hour-glass" shape, that is, with the middle portion of the button of diminished diameter, so it will permit a degree of bending. Because of my novel design, and the highly advantageous relationship of the several components involved, the rotatable latch member 20 is able to be "snapped" into engagement with the male member 10 on occasion, and at a later time "snapped" into its out-of-the-way stowed position on the upper side of the female member 14, in each of which locations it is securely retained.

It is to be realized that because of the design of the legs 26 and 28, and the overall general shape of the rotatable latch member, the outer part 24 of the rotatable latch member 20 has a desirable slight degree of flexibility, this being provided to assist in the goal of achieving the desired "snap" action mentioned hereinabove.

The relationship of the latch member 20 and its semi-flexible outer portion 24; the snap lock button 30; and the placement and configuration of the recesses or receptacles 32 and 34 will shortly be discussed at length in connection with FIGS. 6*a* through 6*f*.

It is important to realize that a disconnect threat to the properly joined male and female electrical members, such as by the appliance user pulling on the cord from a distant location, is not effectively resisted by the fact that the snap lock button 30 extends into the receptacle 32 of the male member. Rather, in order to provide a highly effective arrangement for resisting separation of the plug and socket, I prefer to utilize the raised, curved shoulders 36 and 38 of an outwardly curved or "convex" type on opposite sides of the male member or plug 10, as was revealed in FIGS. 3 and 5. These curved shoulders 36 and 38 are engaged by the inwardly curved portions 46 and 48, which are of essentially the same curvature, hereinafter described as being of a "concave" type, that are located on the interior surfaces of the legs 26 and 28 of the rotatable latch member 20.

Returning to FIG. 3 for a brief review, the raised, accurately shaped shoulder 36 is disposed on the plug 10 at a location approximately midway between the prongs on the left, and the receptacle 32 on the right. With reference again to FIG. 5, it will be seen that the matching raised, accurately shaped shoulder 38 is disposed in a symmetrical relationship on the opposite side of the male member from the shoulder 36. These shoulders are being regarded as being of "convex" curvature in order to distinguish them from the inwardly curved members 46 and 48 located on the inner surfaces of the legs 26 and 28 on the member 20, and as should by now be abundantly clear, the inwardly curved members 46 and 48 are respectively designed to closely interact with the shoulders 36 and 38. In some instances I may wish to refer to the shoulders 36 and 38 as "stator" members, and the inwardly curved portions 46 and 48 of the rotatable latch member 20 as the "rotor" members.

The significance of the curvature of the shoulders 36 and 38 is closely related to the corresponding contour of the surfaces 46 and 48 visible in FIG. 4 on the inner surfaces of the legs 26 and 28 of the rotatable latch member 20. The shoulders 36 and 38 are rounded in the manner depicted in FIG. 3, it is understood that the contoured surfaces 46 and 48 must be curved in a complementary manner in order to enable the rotary latch member to be moved with respect to the male plug, to the firmly latched position. The movement of the rotatable latch member 20 is illustrated in FIGS. 6*b*, 6*c*, 6*e* and 6*f*.

Figure 6B:
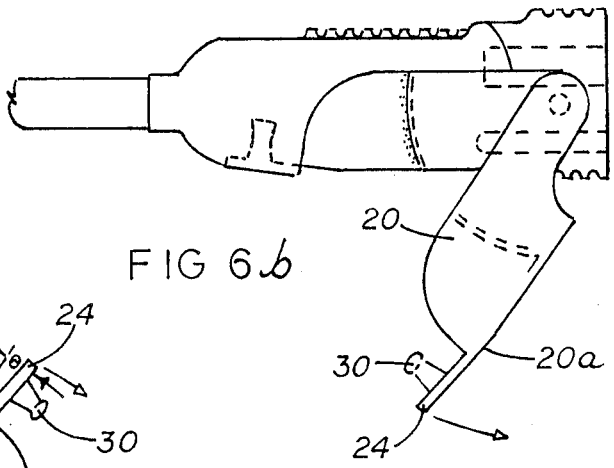
FIG. 6*b* is similar to FIG. 6*a*, but here showing the rotatable latch member having been rotated away from the stowed position.

It is to be seen that FIG. 6*a* is a side elevational view of the inverted female member, with my novel rotatable latch member in the stowed position, and with curved contours provided by the use of dashed lines on this figure revealing the inwardly curved contours of the anterior portions of the legs of the rotatable latch member. FIG. 6*b* is similar to FIG. 6*a*, but it differs by revealing the rotatable latch member 20 having been rotated away from the stowed position.

Figure 6C:
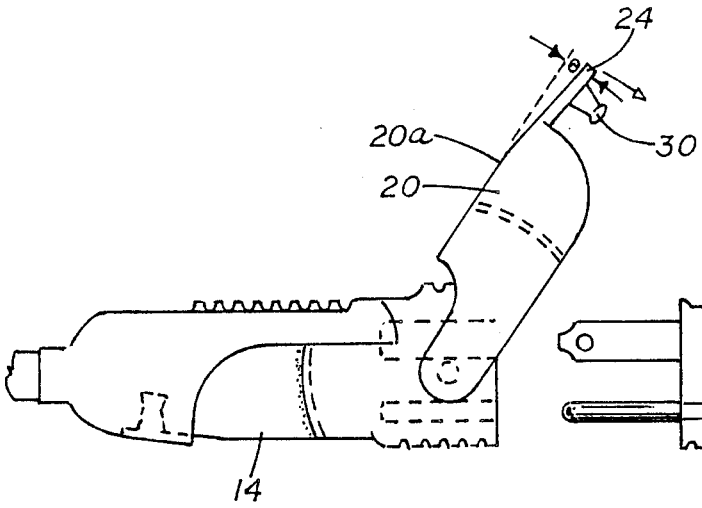
FIG. 6*c* is closely relatable to FIG. 6*b*, but it here reveals the rotatable latch member having been moved to the raised position as will permit entry of the prongs of the male plug into the corresponding socket component of the female member.

FIG. 6*c* is relatable to FIG. 6*b*, but reveals the rotatable latch member 20 having been moved to a raised position as will permit entry of the prongs of the male plug into the corresponding socket component of the female member. It is to be noted that the rotatable latch member 20 needs to have moved from the stowed position through an arc of slightly more than 180° in order to permit the entry of the prongs of the male plug 10 into the electrical recesses of the socket 14, which is to say that it is certainly not necessary for the rotatable latch member 20 to have moved approximately 270° away from the stowed position before connection of the plug and socket can be accomplished, as might have been inferred from viewing the position of the rotatable latch member 20 in FIGS. 2 and 3.

Figure 6D:
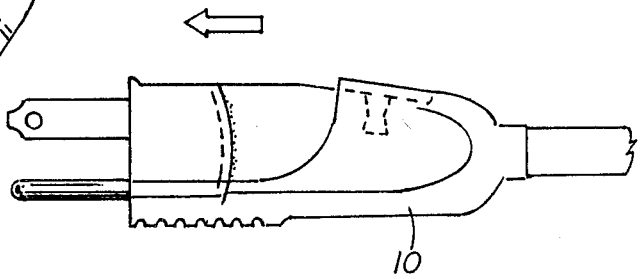
FIG. 6*d* is the inverted male plug, positioned so as to be ready to enter into an interfitting relationship with the female socket, with the raised, outwardly curved shoulder members of the plug being here clearly visible.

FIG. 6*d* is the inverted male plug, positioned so as to be ready to enter into an interfitting relationship with the female socket, with one of the raised, outwardly curved shoulder members of the male plug being here clearly visible.

Figure 6E:
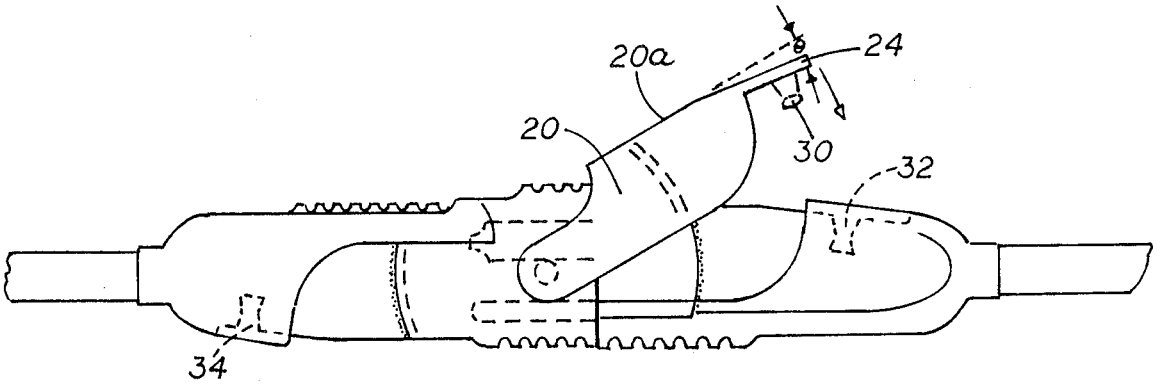
FIG. 6*e* is a view of the joined female socket and male plug, here both in the inverted position, with the rotatable latch member being known shortly before its snap lock button enters the recess or receptacle provided on the male plug.

FIG. 6*e* is a view of the joined female socket and male plug, here both in the inverted position, with the rotatable latch member 20 extending above the plug 10, with the snap lock button 30 poised to enter the recess or receptacle 32 provided on the male plug.

It is to be noted that the outer end 24 of the rotatable latch member 20 is inclined somewhat downwardly, so as to create an acute angle of approximately 10° to 25° with respect to the top surface 20*a* of the main portion of the rotatable latch member 20. This configuration is preferred in order to optimize the relationship between the snap lock button or protuberance 30, and the "hour-glass" shaped receptacles to be found on both the male and the female components. This relationship will be discussed shortly.

Figure 6F:
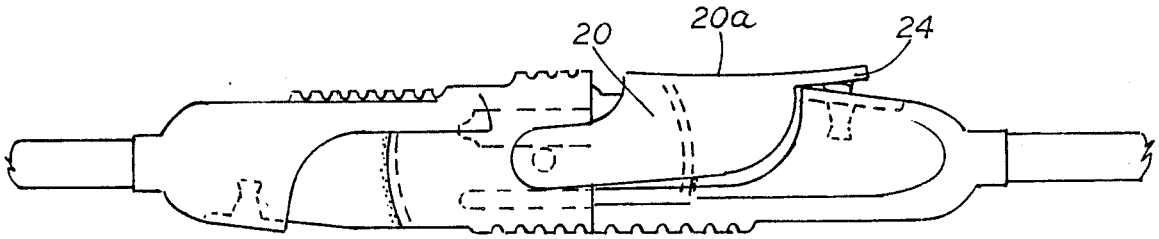
FIG. 6*f* is a view resembling FIG. 6*e*, but here showing the nearly completed entry of the snap lock button into the recess or receptacle of the male plug, to complete the joinder of the electrical members.

FIG. 6*f* is a view resembling FIG. 6*e*, but here showing the nearly completed entry of the snap lock button 30 into the recess or receptacle 32 of the male plug, depicting in a slightly exaggerated manner the "flexing" or spring-like action of the outer part 24, as the snap lock button or protuberance 30 enters the receptacle or retaining hole 32.

It is to be realized with respect to my invention that when the rotatable latch member 20 is either in the stowed position on the female member or socket as in FIG. 6*a*, or when the female and male members are engaged and firmly plugged together and the rotatable latch member is moved toward the engage or snap lock position as depicted in FIG. 6*f*, the geometry is such that the hour-glass shaped snap-lock receptacle in either the female or the male member is "just beyond" the normal reach of the protruding snap lock button 30.

The result of this highly advantageous "just beyond" configuration is to cause the semi-flexible, downward angled end 24 of the rotatable latch or "roto-latch" member to flex slightly upward, in the manner of a leaf spring, just enough to allow the snap lock button 30 to move past the near edge of the snap lock receptacle 32 or 34, and then seat completely. Thereafter, the combined shape of the snap lock button 30, the snap lock receptacle 32 or 34, and the flexing, spring like action of the roto-latch itself, combine to effect a firm snap lock and holding action of the total roto-latch mechanism 20. In other words, the preferred angularity of the outer portion 24 serves to create, in effect, a continuous bias between the button 30 and the pivot points 22, which causes the button to seat properly and be effectively retained in the recess or receptacle.

It is to be realized that the button or protuberance 30 is disposed at right angles to the angled portion 24, and that each receptacle or recess 32 or 34 is angled so as to properly receive the protuberance or button 30. In other words, if the outer portion is disposed at a certain angle in the range of 10° to 25°, and the button is perpendicular thereto, then the recess 32 or 34 should be disposed at the same angle with respect to the centerline of the member 14.

When the male and female members have been electrically and mechanically joined, and the rotatable latching member is in the latching position, it is to be realized that the protuberance or button 30 properly resides in the recess 32, for the distance on the rotatable latching member from the pivot points 22 to the button 30 is the same as the distance from the pivot point 22 to the recess 32, and in this instance, the principal aspect keeping the button in the recess is the angularity deliberately imposed upon the outer portion 24 with respect to the main body of the rotatable latch member 20.

It is important to note again that the highly advantageous "snap lock" feature in accordance with invention does not, nor is it intended to, securely hold the female socket and male plug ends together as will by itself prevent them from being pulled apart. Rather, my "snap lock" feature is only meant to securely hold the rotatable latch member or roto-latch mechanism in the selected position on the male or the female member, so that the rotatable latch member will not inadvertently move out of the properly latched position. In that way, the "snap lock" feature assures that the roto-latch remains fully stowed when not in use, as well as fully engaged when being utilized with an appliance fitted with a compatible male electric plug end.

I prefer for my highly advantageous snap lock feature to be sufficiently effective in its operation that the user may need to resort to a fingernail or the like in order to pull the button or protuberance upwardly against the spring bias imposed by the angularity of the angled outer portion 24, or flex bias, until the button emerges from the recess or receptacle.

Figure 5:
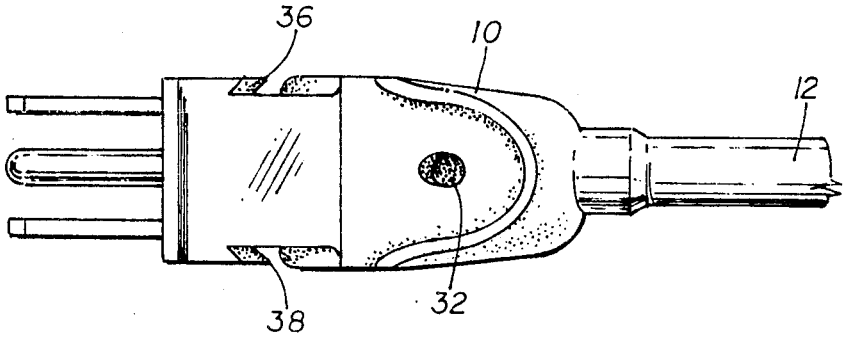
FIG. 5 is a view of the underside of the male plug, here revealing the outwardly curved members that are engaged by the inwardly curved portions on the female member, and also showing the recess or receptacle of generally hour-glass shape that is intended to receive the snap lock button of the rotatable latch member at such time as the female socket and male plug have been joined.

It should now be clearly understood that positive engaging and locking together of the female socket and male plug ends is accomplished by, and enhanced by, the mutual engagement of the inwardly angled edges of the combined rotor and stator components of the male electric plug ends and the rotatable latch member as depicted in FIGS. 3, 4 and 5. The angled edges I use on the shoulders 36 and 38, and the curved surfaces 46 and 48, causes the rotors and stators to snug up and more closely engage, which effects an even tighter lock up if tension is applied to either the extension cord or the electrical appliance attached thereto, thereby further preventing undesired separation or unplugging of the electrical device in use.

It is to be realized that I am not to be limited to the specific latching arrangement or retention means explained at some length in conjunction with FIGS. 6*a* through 6*f*.

In the context of keeping the outermost end 24 of the rotatable latch member 20 in the secured or latched position, a pair of spaced-apart spring wires could be placed in receptacle or recess 32 in FIG. 6*e*. Such wires would be closer together than the enlarged tip of the button member or protuberance 30, and would need to move or spring apart in order to permit the entry of the button member 30. However, as soon as the user has caused the enlarged tip to pass between the wires, the wires would automatically spring back and clasp the midportion of the hour-glass shaped button or protuberance 30.

A major argument in favor of the arrangement primarily described in connection with FIGS. 6*a* through 6*f*, however, the fact that the locking components there utilized are readily achieved or created during the manufacturing process, and no need exists for the separate step of inserting the spring wires.

I claim:

1. An electrical connector securing arrangement for use upon the female socket of an extension cord, to prevent the unintentional separation from the socket of a male plug that has been interfitted therewith, said electrical connector securing arrangement comprising a socket having thereon a pivotally mounted rotatable latch member, rotatable between extreme positions that are more than 180 degrees apart, and a specially configured compatible male plug utilized with said socket, said rotatable latch member having a raised and shaped central locking portion able to releasably engage a portion of said plug when said rotatable latch member is in an extended position of its rotation, and thus effectively prevent undesired separation of said socket and plug when interfitted, said central locking portion of said rotatable latch member having the ability to be towed unobtrusively on a certain recessed and shielded part of the body of said socket when said socket and said plug have been separated, and said rotatable latch member has been moved to an extreme or retracted position of its rotation, the stowing of said rotatable latch member in said recessed and shielded location on said socket serving to prevent same from becoming snagged on a nearby object.

2. The electrical connector securing arrangement as defined in claim 1 in which a raised and shaped, inwardly curved rotor member is located on an interior or inboard portion of each side leg of said rotatable latch member, closely adjacent to its pivot locations, each inwardly curved member being arranged to frictionally engage and grasp a respective raised and complementary shaped, outwardly curved stator member on each side of said plug, thus to cause said socket and plug to tightly interfit, and to effectively prevent undesired separation of same.

3. An electrical connector securing arrangement for use upon the female socket of an extension cord, to prevent the unintentional separation from the socket of a male plug that has been mechanically as well as electrically interfitted with said socket, said electrical connector securing arrangement comprising a socket having thereon a pivotally mounted rotatable latch member, rotatable between extreme positions that are more than 180 degrees apart, and a specially configured compatible male plug utilized with said socket, said plug having a relatively small, generally circular recess formed in an outer portion thereof, said rotatable latch member having a raised and shaped central locking portion equipped with a protuberance able to releasably engage said generally circular recess in said plug when said rotatable latch member is in an extended position of its rotation, and thus effectively help prevent, when said rotatable latch member is in its latching position, any undesired separation of said socket and plug when interfitted, said rotatable latch member having the ability to be unobtrusively stowed on a certain recessed and shielded part of the body of said socket after said socket and said plug have been separated, and said rotatable latch member has been moved to an extreme or retracted position of its rotation, where said protuberance on said central locking portion then enters a generally circular recess provided on the outer body of said socket, the stowing of said rotatable latch member in such recessed and shielded location on said socket serving to prevent said rotatable latch member from becoming snagged on a nearby object, even if dragged on the ground.

4. An electrical connector securing arrangement for use upon the female socket of an extension cord, to prevent the unintentional separation from the socket of a male plug that has been mechanically as well as electrically interfitted with said socket, said electrical connector securing arrangement comprising a socket having thereon a pivotally mounted rotatable latch member, rotatable between extreme positions that are more than 180 degrees apart, and a compatible male plug utilized with said socket, said plug having a relatively small, generally circular recess formed in an outer portion thereof, said rotatable latch member having a central locking portion equipped with a protuberance able to releasably engage said generally circular recess in said plug when said rotatable latch member is in one position of its rotation, and thus effectively help prevent, when said rotatable latch member is in its latching position, any undesired separation of said socket and plug when interfitted, said rotatable latch member being able to be unobtrusively stowed on a certain designated part of the body of said socket after said socket and said plug have been separated, and said rotatable latch member has been moved to an extreme position of its rotation, where said protuberance on said central locking portion then enters a generally circular recess provided on the outer body of said socket, the stowing of said rotatable latch member in such unobtrusive location on said socket serving to prevent said rotatable latch member from becoming snagged on a nearby object, even if dragged on the ground, said central locking portion of said rotatable latch member being of semi-flexible material and having a normal position, with said protuberance mounted on said central locking portion, said protuberance being able to be inserted into said recess located on the outer portion of said male plug when said male and female members have been mechanically as well as electrically joined, and said rotatable latch member has been rotated toward its latching position, said protuberance being able to enter said recess only after said central locking portion of semi-flexible material has been caused to bend backward, a few degrees away from its normal position, only then to permit a sudden, relatively forceful entry of said protuberance into said recess.

5. An electrical connector securing arrangement for use upon the female socket of an extension cord, to prevent the unintentional separation from the socket of a male plug that has been mechanically as well as electrically interfitted with said socket, said electrical connector securing arrangement comprising a socket having thereon a pivotally mounted rotatable latch member, rotatable between extreme positions that are more than 180 degrees apart, and a compatible male plug utilized with said socket, said plug having a relatively small, generally circular recess formed in an outer portion thereof, said rotatable latch member having a central locking portion equipped with a protuberance able to releasably engage said generally circular recess in said plug when said rotatable member is in one position of its rotation, and thus effectively help prevent, when said rotatable latch member is in its latching position, any undesired separation of said socket and plug when interfitted, said rotatable latch member being able to be unobtrusively stowed on a certain designated part of the body of said socket after said socket and said plug have been separated, and said rotatable latch member has been moved to an extreme position of its rotation, where said protuberance on said central locking portion then enters a generally circular recess provided on the outer body of said socket, the stowing of said rotatable latch member in such unobtrusive location on said socket serving to prevent said rotatable latch member from becoming engaged on a nearby object, even if dragged on the ground, an inwardly curved member being located on an interior portion of each side of said rotatable latch member, closely adjacent its pivot locations, each inwardly curved member being arranged to frictionally engage a respective raised, outwardly curved member on the side of said plug, thus to cause said socket and plug to tightly interfit, and to effectively prevent undesired separation of same.

6. An electrical connector securing arrangement for use with the female socket of an extension cord, to prevent the unintentional separation from the socket of a male plug that has been interfitted therewith, said connector securing arrangement comprising a socket having thereon a pivotally mounted rotatable latch member rotatable between extreme positions that are more than 180° and less than 300° apart, and a compatible male plug utilized with said socket, said rotatable latch member having a central locking portion able to releasably engage a portion of said plug when said rotatable latch member is in one extreme position of rotation, and thus help prevent undesired separation of said socket and plug when interfitted, said central locking portion of said rotatable latch member being able to be unobtrusively stowed on a certain designated part of the body of said socket when separated from said plug, and said rotatable latch member has been moved to the other extreme position of its rotation, the stowing of said rotatable latch member in an unobtrusive location on said socket serving to prevent same from becoming snagged on a nearby object.

7. The electrical connector securing arrangement as defined in claim 6 in which said pivotally mounted rotatable latch member is rotatable for approximately 270° between its extreme positions.

8. The electrical connector securing arrangement as defined in claim 6 in which an inwardly curved member is located on each side of said rotatable latch member, closely adjacent its pivot locations, each inwardly curved member being arranged to frictionally engage a respective raised, outwardly curved member on the side of said plug, thus to cause said socket and plug to tightly interfit, and to effectively prevent undesired separation of same.

9. An electrical connector securing arrangement for use with the female socket of an extension cord, to prevent the unintentional separation from the socket of a male plug that has been interfitted therewith, said electrical connector securing arrangement comprising a socket having thereon a pivotally mounted rotatable latch member, rotatable between extreme positions that are more than 180° and less than 300° apart, and a compatible male plug utilized with said socket, said rotatable latch member having a central locking portion able to releasably engage a portion of said plug when said rotatable latch member is in one extreme position of rotation, and thus help prevent undesired separation of said socket and plug when interfitted, said central locking portion of said rotatable latch member being able to be unobtrusively stowed on a certain designated part of the body of said socket when separated from said plug, and said rotatable latch member has been moved to the other extreme position of its rotation, the stowing of said rotatable latch member is an unobtrusive location on said socket serving to prevent same from becoming snagged on a nearby object said central locking portion of said rotatable latch member being of semi-flexible material and having a normal position, a protuberance mounted on said central locking portion, said plug having a generally circular recess on tis outer portion, said protuberance being able to be inserted into said recess located on said plug when said male and female members have been mechanically as well as electrically joined, and said rotatable latch member has been rotated toward its latching position, said protuberance being able to enter said recess only after said central locking portion of semi-flexible material has been caused to bend backward, a few degrees away from its normal position, only then to permit a sudden, relatively forceful entry of said protuberance into said recess.

10. The electrical connector securing arrangement as defined in claim 9 in which said female socket also has a generally circular recess, into which said protuberance can be inserted when said rotatable latch member is to be stored in an unobtrusive position.

* * * * *